United States Patent [19]

Coker et al.

[11] Patent Number: 4,651,890

[45] Date of Patent: Mar. 24, 1987

[54] BEVERAGE CAN WIPE STORED IN POUCH AFFIXED TO CAN

[76] Inventors: Gregory F. Coker, 276 Parliament Cir., Topsham, Me. 04086; Bradford A. Armstrong, VRC-50 P.O. Box 437, NAS CUBI PT FPO SF, Calif. 96654-2760

[21] Appl. No.: 860,535

[22] Filed: May 7, 1986

[51] Int. Cl.[4] ..... B65D 79/00

[52] U.S. Cl. ..... 220/85 R; 220/23; 220/66; 215/6

[58] Field of Search ..... 220/85 R, 87, 66, 23; 215/100 R, 100.5, 6

[56] References Cited

U.S. PATENT DOCUMENTS

| | | | |
|---|---|---|---|
| 1,545,026 | 7/1925 | Armstrong | 220/85 R |
| 1,879,517 | 9/1932 | Rowbotham | 220/85 R |
| 2,292,413 | 8/1942 | Taylor | 220/23 X |
| 2,310,491 | 2/1943 | Molow | 215/6 |
| 3,000,035 | 9/1961 | Harris et al. | 220/23 X |
| 3,730,383 | 5/1973 | Dunn et al. | 220/66 |
| 4,522,298 | 6/1985 | Weinberger | 220/23 X |

*Primary Examiner*—Steven M. Pollard

[57] ABSTRACT

A readily openable pouch containing a moistened hygenic cleaning pad is attached to the bottom of a beverage can. The pad can be removed from the pouch and used to wipe and sanitize the can top and adjacent side wall prior to drinking from the can through a top orifice. After use the pad may be replaced in the pouch for discarding with empty can.

11 Claims, 7 Drawing Figures

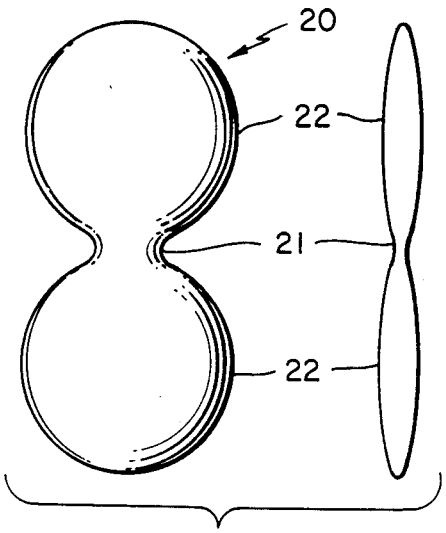
FIG. 4
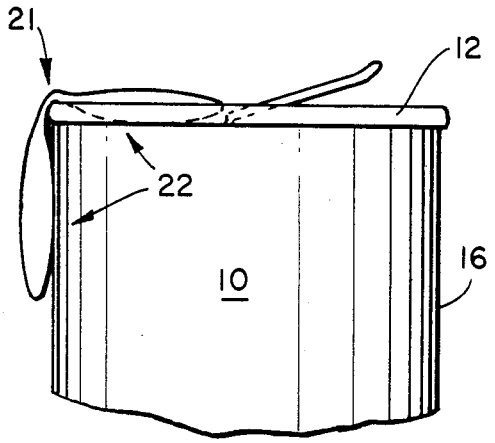
FIG. 5
FIG. 6
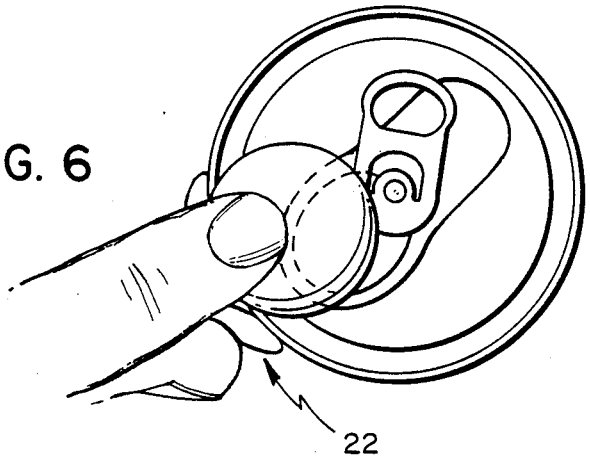
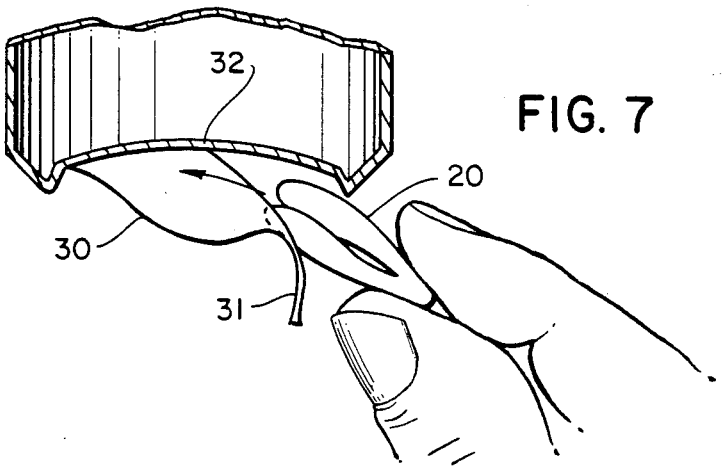
FIG. 7

BEVERAGE CAN WIPE STORED IN POUCH AFFIXED TO CAN

BACKGROUND OF THE INVENTION

Beer and soft drinks are commonly drunk directly from the container in which sold at the store. The usual beverage can has a flat top having an area corresponding to the cross-section of the can. It is ideal for collecting dust and dirt and is easily contaminated by bacteria during transportation from the canning plant to the distributor and from the distributor to the dealer, to say nothing of the periods of time during which it is stored at the various locations which may be anything but hygienic.

It has heretofore been proposed to maintain portions of a beverage container top in sanitary condition by the use of covers. For example, see U.S. Pat. Nos. 2,740,547; 3,182,393; 3,204,805, and 3,690,509. Likewise the provision of a moist cleaning cloth in a sealed packet for carrying with the person and use for wiping and refreshing the face and hands is known (U.S. Pat. No. 4,220,244).

So far as I am aware, the prior art does not disclose a device removably secured in a pouch in the recess in the bottom of a beverage can for containing a pad which may be readily extracted from the pouch and used to wipe and sanitize the can top prior to drinking from it.

SUMMARY OF THE INVENTION

The principal object of the invention is to provide a cleaning pad conveniently stored in a sealed pouch carried by a beverage can in the recess in its bottom, the pad being readily removable for use by the consumer in wiping clean the orifice in the top of the can and the surrounding area of the top and side wall prior to drinking from the can.

Another object is to provide such a stored pad which preferably has been impregnated with non-toxic cleaning and germicide solution the better to clean and sanitize the top and adjacent wall of the can.

A further object is to provide a pad-containing pouch which will fit the recess in the bottom of the can so as to be non-obtrusive and non-interfering with standing up and stacking of the cans.

A still further object is to provide a pad for the above described purpose which is specially shaped for cleaning the uniquely shaped top portion of most beverage cans.

An additional object of the invention is to provide a storage pouch of the type described which is adapted after being opened to once again receive and hold the used pad for later disposal with the empty can.

In accordance with the invention, there is provided a readily openable and at least partially recloseable sealed pouch containing a moistened hygienic wiping pad, the pouch being adhered in the recess of the bottom of a beverage can so as to accompany the can in its travel to the ultimate consumer, whereby the consumer may prior to drinking from the can remove the pad from the pouch and use it to wipe and sanitize the can top orifice and surrounding surface.

More particularly, in accordance with the invention, I provide, in combination with a beverage can having a recessed bottom and a top provided with a beverage dispensing opening, a pouch attached within the recess in the bottom of the can and a cleaning pad stored within the pouch, the pouch being openable by the user to facilitate withdrawal of the pad for use and reinsertion of the pad after use, the pad being adapted for cleaning and sanitizing the top portion and wall of the can adjacent the opening prior to the user's drinking therefrom.

In preferred embodiments the cleaning pad is hourglass shaped and is impregnated with a non-toxic germicidal and cleaning medium; it is formed by a pair of plies of plastic material sealed to each other along their edges, the upper ply being adhered to the base of the can and the lower ply forming a protective shield covering for the pad.

In still further preferred embodiments, the lower ply is convex in shape and resilient thereby to provide a safety feature such that prior to being opened it will present a firm bubble-like feeling to the touch, indicating that it has not been tampered with, and, after opening, will remain hinged to the other ply and tend to return to closed position against the other ply, whereby a used pad may be reinserted in and retained by the pouch for subsequent discarding with the empty can; a pull tab is provided for separating the lower ply from the upper ply; there are provided means for limiting the degree of opening of the lower ply when actuated by the pull tab; and the pouch is adapted not to protrude beneath the can, whereby the can is not destabilized and stacking of cans facilitated.

Further objects, advantages and features of the invention will be apparent from the following detailed description of a preferred embodiment taken in conjunction with the accompanying drawings.

BRIEF DESCRIPTION OF THE DRAWINGS

FIG. 4 is a composite showing plan and edge views of the cleaning pad itself after removal from the pouch;

FIG. 5 is an elevation of the top portion of a can showing how the pad conforms to the shape of the can as it cleans;

FIG. 6 is a top view of the can illustrating how the pad is used to clean the orifice and surrounding areas thereof; and FIG. 7 is another view, partially in section, of the bottom portion of the can showing how the cleaning pad after use can be returned to its storage pouch for disposal with the can.

DETAILED DESCRIPTION OF PREFERRED EMBODIMENTS

Figure 1:
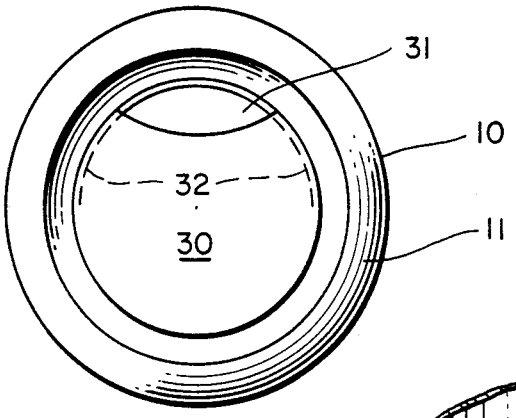
FIG. 1 is a bottom view of a beverage can showing the pad-containing pouch of the invention affixed within the recess in the base of the can.
Figure 2:
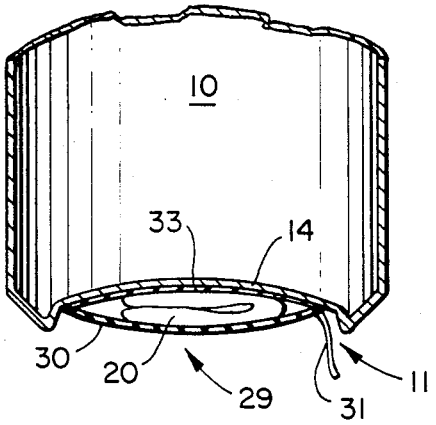
FIG. 2 is a view partially in section of the base of the can showing the pad-containing pouch in its recess illustrating the pull tab which facilitates opening the pouch.
Figure 3:
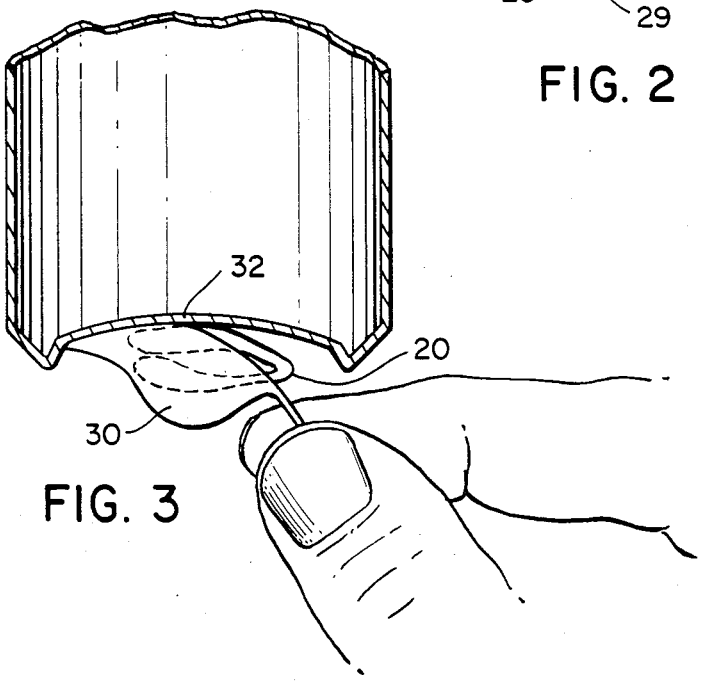
FIG. 3 is a view similar to FIG. 2 illustrating the mode of operation of the pull tab to open the pouch.

Referring to FIGS. 1–3, it can be seen that the pad 20 is specifically designed so as when folded to fit neatly and unobtrusively in its pouch 29 within the concave space 11 formed in the base of the beverage can 10. FIGS. 1–3 show the cleaning pad 20 stored within the space provided by the storage pouch. The upper ply 33 of the pouch is firmly attached by any suitable means, as by an adhesive, to the base 14 of the can. The pouch is designed with a touch outer plastic shield 30 providing protection from the elements.

The opening of the pouch is facilitated by a handy pull tab 31, as illustrated in FIGS. 2 and 3, permitting the pad to be removed for use. The pouch is designed to open only to a predetermined point 32. This preserves the integrity of the pouch allowing the convex shaped outer plastic shield 30 to return to its original shape as shown in FIG. 7 so as to provide the means within which to store the cleaning pad for disposal with the can after its use by the consumer. The outer cover 30 and the inner liner 33 which together form the pouch provide a moisture proof seal ensuring the functional integrity of the cleaning pad. Furthermore, the unopened pouch on the can provides a distinct and unique safety feature. By lightly pushing on the unopened protective plastic covering before use, the consumer is able readily to determine if the pad has been tampered with such as to make it unsafe to use or, if through inadvertent rupture of the pouch, it has been exposed to the environment. A firm, bubble-like feeling will be sensed if the structural integrity of the pouch and pad are undisturbed, thereby indicating it is clean and safe to use. However, if the protective casing has been ruptured or opened, thereby exposing the pad the the exterior elements, the lower ply will yield readily to finger pressure giving the user an early warning not to attempt to wipe the can top clean with the pad.

The pre-moistened pad itself is illustrated in FIG. 4. The plan view reveals the hour-glass like shape of the pad with a cross-section dramatizing the relative thickness of the pad. The narrow bridge 21 joins the two circular cleaning portions 22. As illustrated in FIGS. 5 and 6, this bridge allows the pad to span the beverage can's angular rim 12 permitting the two spongy pads 22 better to conform to and best clean behind the beverage can's rim. The split pad design 22 permits easy cleaning by a simple side-to-side motion of both the upper surface of the can (FIG. 6) and the rim 12 and side 16 (FIG. 5).

In contrast with the removable covers of the prior art, the present invention provides a simple and inexpensive means, readily available with the beverage can, for quickly sanitizing the can top for drinking purposes at the time of use. Since a bottom recess is common to most beverage cans, there is no need to alter the fundamental can construction in order to accommodate the pad holding pouch of the invention. It readily fits existing cans. Further, the pouch may be attached either at the factory by one additional step in manufacture, or at some convenient point further along the line.

The dumbbell or hour-glass shape of the cleaning pad is a preferable feature. First, it enables folding the pad to substantially circular form to permit ready insertion in its pouch. This configuration adapts the unit best to fit and be recessed in the circular can bottom. Second, when unfolded, it provides one portion particularly adapted for wiping the can side wall and another similar portion especially suited for simultaneously wiping the can top.

While I have herein described and disclosed a presently preferred embodiment of the invention, it will nevertheless be understood that the disclosure is by way of illustration and not by way of limitation and it is intended that the scope of the invention be limited only by the proper interpretation to be afforded the appended claims.

We claim:

1. In combination with a beverage can having a recessed bottom and a top provided with a beverage dispensing opening, a pouch attached within the recess in the bottom of said can and a cleaning pad stored within said pouch, said pouch being openable by the user to facilitate withdrawal of said pad for use and reinsertion of said pad after use, said pad being adapted for cleaning and sanitizing the top portion and wall of said can adjacent said opening prior to drinking therefrom.

2. The combination of claim 1 wherein said pad is hour-glass shaped.

3. The combination of claim 1 wherein said pad is impregnated with a non-toxic germicidal and cleaning medium.

4. The combination of claim 1 wherein said pouch is formed by a pair of plies of plastic material sealed to each other along their edges, the upper of said plies being adhered to the base of said can and the lower of said plies forming a protective shield covering said pad.

5. The combination of claim 4 wherein said lower ply is downwardly convex in shape and formed of resilient plastic sealed by its edges to the upper ply whereby the user may readily determine by pressing on it prior to opening whether the structural integrity of the pouch and pad has been compromised.

6. The combination of claim 4 wherein the seal between said plies is so disposed and arranged that the pouch can be opened only to a predetermined point whereby the pad may be removed for use and then returned to the pouch for disposal with the can.

7. The combination of claim 6 including means for limiting the degree of opening of said lower ply when actuated by said pull tab.

8. The combination of claim 4 wherein said lower ply is convex and stiff and after opening will remain hinged to the other ply and tend to return to closed position against the other ply after opening whereby a used pad may be reinserted in and retained by said pouch for subsequent discarding with the empty can.

9. The combination of claim 4 including a pull tab for separating said lower ply from said upper ply.

10. The combination of claim 4 wherein said lower ply is provided with a pull tab to facilitate manual opening of the pouch.

11. The combination of claim 1 wherein said pouch is held in said recess so as not to protrude beneath the can so as not to destabilize the can and to facilitate stacking of the cans.

* * * * *